United States Patent [19]

Przybyła et al.

[11] 4,312,207

[45] Jan. 26, 1982

[54] ROLLING MILL FOR FORMING CROSS RIBBED PIPES

[75] Inventors: Janusz Przybyła, Ząbkowice Będzińskie; Leopold Haczek, Gliwice; Zygmunt Goździewicz; Andrzej Szal, both of Kędzierzyn-Koźle; Józef Pieczyk, Walce; Andrzej Maczyński, Kędzierzyn-Koźle, all of Poland

[73] Assignee: Zakład Doświadczalny Przy Zakładach Urządzeń Chemiczynch "Metalchem", Kędzierzyn-Kozle, Poland

[21] Appl. No.: 100,766

[22] Filed: Dec. 6, 1979

[30] Foreign Application Priority Data

Dec. 6, 1978 [PL] Poland ..... 211542

[51] Int. Cl.[3] ..... B21B 31/32

[52] U.S. Cl. ..... 72/100; 72/95; 72/245

[58] Field of Search ..... 72/80, 95, 98, 100, 72/238, 245, 453.02, 453.05, 453.06, 453.07, 453.08

[56] References Cited

U.S. PATENT DOCUMENTS 2,730,158 1/1956 Heintz ..... 72/98
3,389,589 6/1968 Siegerist et al. ..... 72/245

FOREIGN PATENT DOCUMENTS 2037839 2/1972 Fed. Rep. of Germany .
493285 2/1976 U.S.S.R. ..... 72/95

*Primary Examiner*—Lowell A. Larson
*Attorney, Agent, or Firm*—Ladas & Parry

[57] ABSTRACT

A rolling mill is characterized in that three hydraulic actuators, positioned in a mill frame and comprising yokes with attached rolling tools therein, are provided with a piston rod having two pistons. The outer piston co-operates with an external cylinder which is mounted on a body of the actuator by means of a threaded joint. The inner piston co-operates with an internal cylinder attached slidably within said body.

At one end, the piston rod is provided with a thrust flange being in contact with spacer washers mounted on the external cylinder, whereas the opposite end of said piston rod includes a stop positioned in a seat of a slider, said stop co-operating with a shoulder on said slider. The slider is mounted slidably on a bottom of the internal cylinder, the end portion of said slider having a pressure flange to press down a tool yoke to the bottom of the internal cylinder during rolling operation.

This invention provides an adjustable rolling mill with an accurate and dependable tool setting, in addition to a simple and time-saving replacement of the tools.

2 Claims, 4 Drawing Figures

ROLLING MILL FOR FORMING CROSS RIBBED PIPES

BACKGROUND OF THE INVENTION

The invention relates to a rolling mill for forming ribs on pipe. The ribbed pipes are used for heat exchangers in many applications.

The known rolling mills for forming ribbed pipes are equipped with a mill stand as a basic working unit. This mill housing is usually provided with three seats symetrically positioned relative to a vertical axis and fitted with hydraulic actuators with yokes, in which are rotatably mounted rolling tools. The tools in the form of packs of shaped discs mounted on common shafts, are driven by a common motor through shafts with Cardan joints. The tools are compressed from three sides against the pipe by hydraulic actuators, and this pressure together with rotation of said tools causes plastic strains in the pipe thus forming ribs.

Geometric parameters of rolling are controlled by adequate setting of the actuators in relation to the housing. And so, by shifting the actuator perpendicularly to the rolling axis, most often with a screw gear, a distance of the tool from a pipe being rolled is changed, and thereby the depth of ribs. By shifting hydraulically the tool from the pipe periodic ribbing of a predetermined pitch is obtained. To secure a particular fin pitch, the axes of the tools are set at a suitable angle relative to the rolling axis, the proper operation of the rolling mill being dependent on setting this angle uniformly for all the tools.

Most often, this is performed individually for each of the seats by turning a piston or cylinder of the actuator.

A rolling mill, referred to in Polish Patent Applications No. P-166964, is provided with tools attached directly to a movable piston, with which an angle of torsion of roller axes is set up in relation to rolling axis, and at the same time, the piston reciprocates to perform periodic rolling the ribs on a pipe.

Another example is a rolling mill referred to in Polish Patent application No. P-178698, wherein the tools are fixed directly to a movable cylinder, whose to-and-fro motion assures periodic rolling the ribs on a pipe, and an angle of torsion of axes of rollers relative to the rolling axis is accomplished simultaneously for three cylinders by intermediate means engaged with said cylinders.

The so designed rolling mills to form cross ribbed pipes do not result in easy and accurate fixing the tools and adjustment of performance parameters for a rolling mill. Assembly and current control of satisfactory operation of the attachment are difficult due to a complicated design of the whole mill stand. Equally complicated are devices shown in USSR Pat. No. 493,285 as well as U.S. Pat. Nos. 2,730,158 and 3,389,589, and German Published Application No. 2,037,839.

SUMMARY OF THE INVENTION

The aim of the invention was to design a rolling mill with simple and reliable tool setting.

The nature of the invention consists in that the rolling mill is provided with a movable piston rod with two pistons in each of three actuator assemblies on the mill stand. The external piston cooperates with an outer cylinder mounted by a threaded joint in an actuator frame, whereas the inner piston is in operative communication with an internal cylinder slidably mounted on said actuator frame.

By means of a stop device, the piston rod is connected to a flange on a slider, said slider having a pressure flange to attack a yoke of a tool with the inner cylinder. At one end, the piston-rod is provided with a thrust flange which mates with replaceable spacer washers rigidly fixed to said external cylinder.

The actuator frame is rotatably mounted on the mill housing, so that its axis is perpendicular to rolling axis. The slider has a flange co-operating with the bottom of said inner cylinder, and a seat for slidable mounting of the said piston rod stop.

Using the hydraulic actuator equipped with the two-piston rod and mating slider enables a simple and accurate spacing of the rolling tools and their exchange in a convenient manner. This exchange consists in pulling out of the loosened seat the yoke together with tool and the operation takes not much time and no subsequent readjustment of the rolling mill is necessary. The adjustment of the skew angle of the tools is set up individually for each of the assemblies, which is advantageous for obtaining a desired setting and the operation is simple and time-saving due to easy access to the frame of the actuator.

BRIEF DESCRIPTION OF DRAWINGS

The rolling mill design, according to the invention, is illustrated in drawings where cross-sections of the assemblies with actuators and tools are shown.

DESCRIPTION OF THE PREFERRED EMBODIMENT

Figure 1:
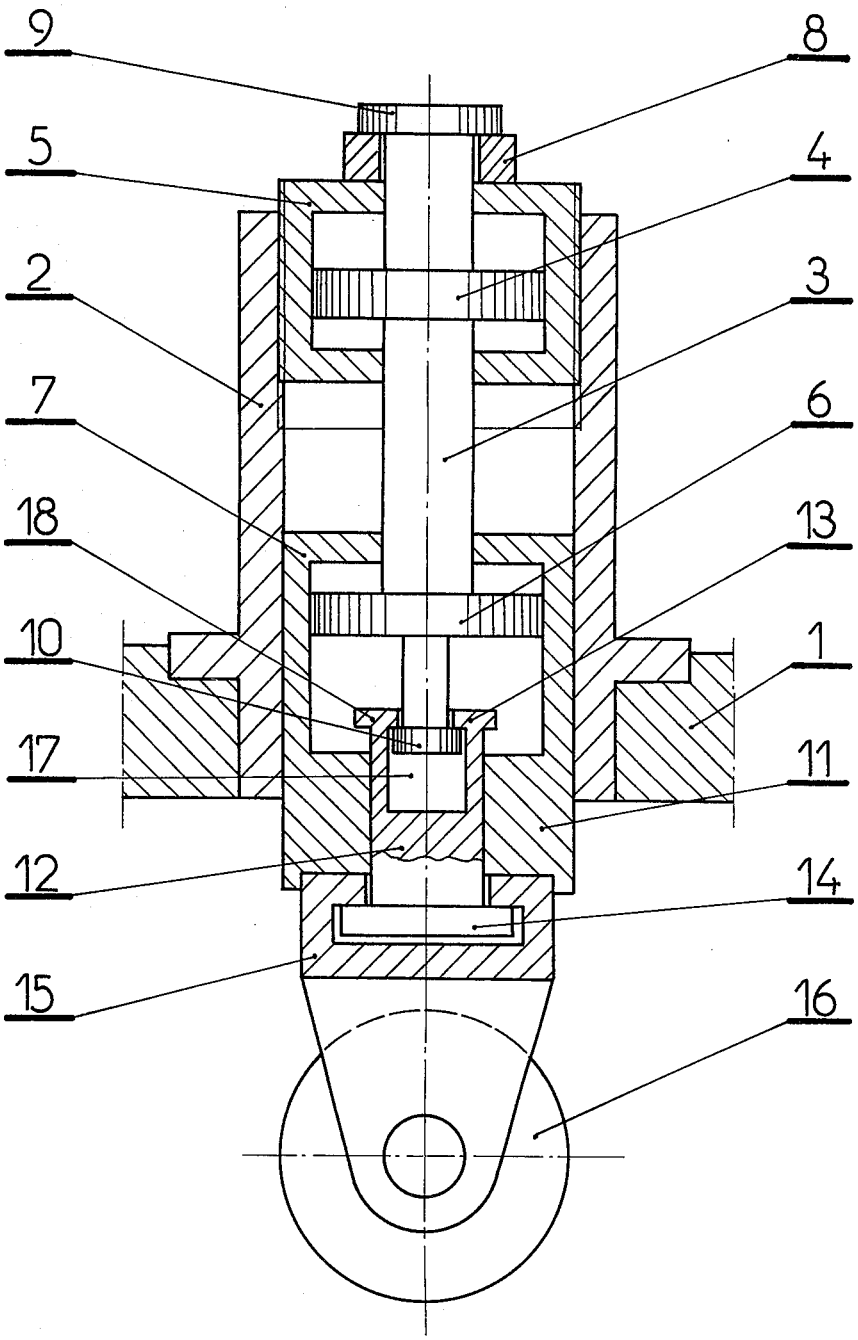
FIG. 1. is a section of the actuator with pressed tool during rolling operation.
Figure 2:
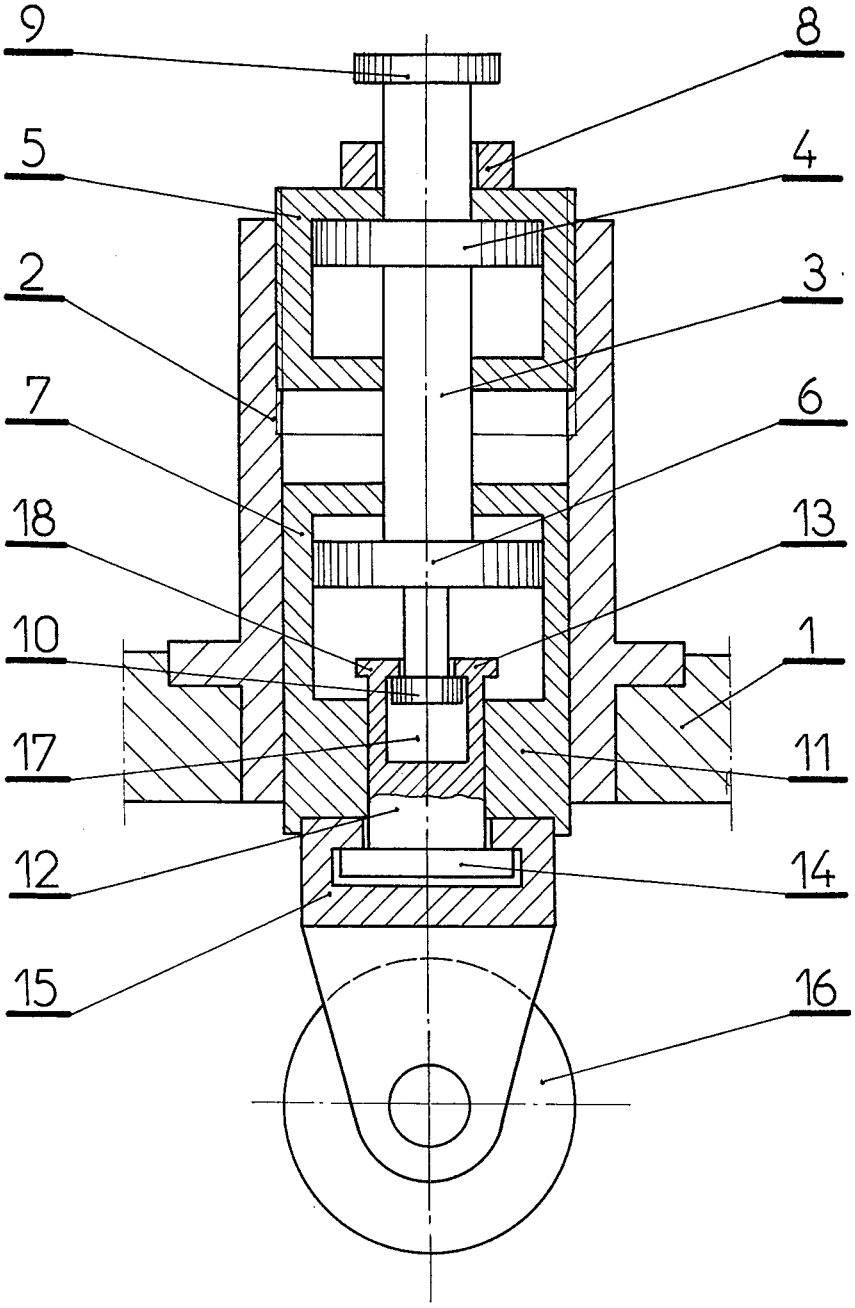
FIG. 2 illustrates the actuator when rib forming is interrupted.
Figure 3:
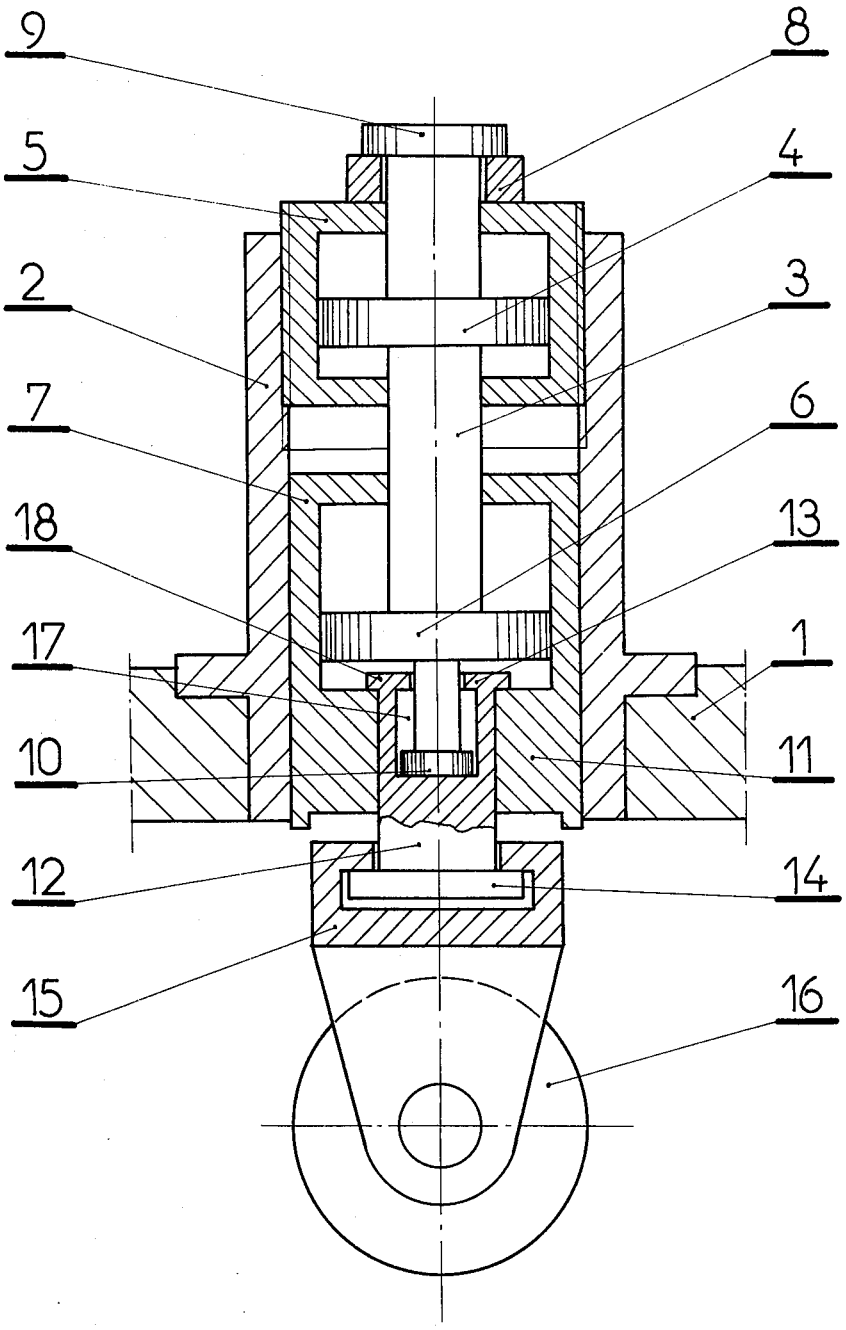
FIG. 3 represents the actuator with a loosely mounted tool.
Figure 4:
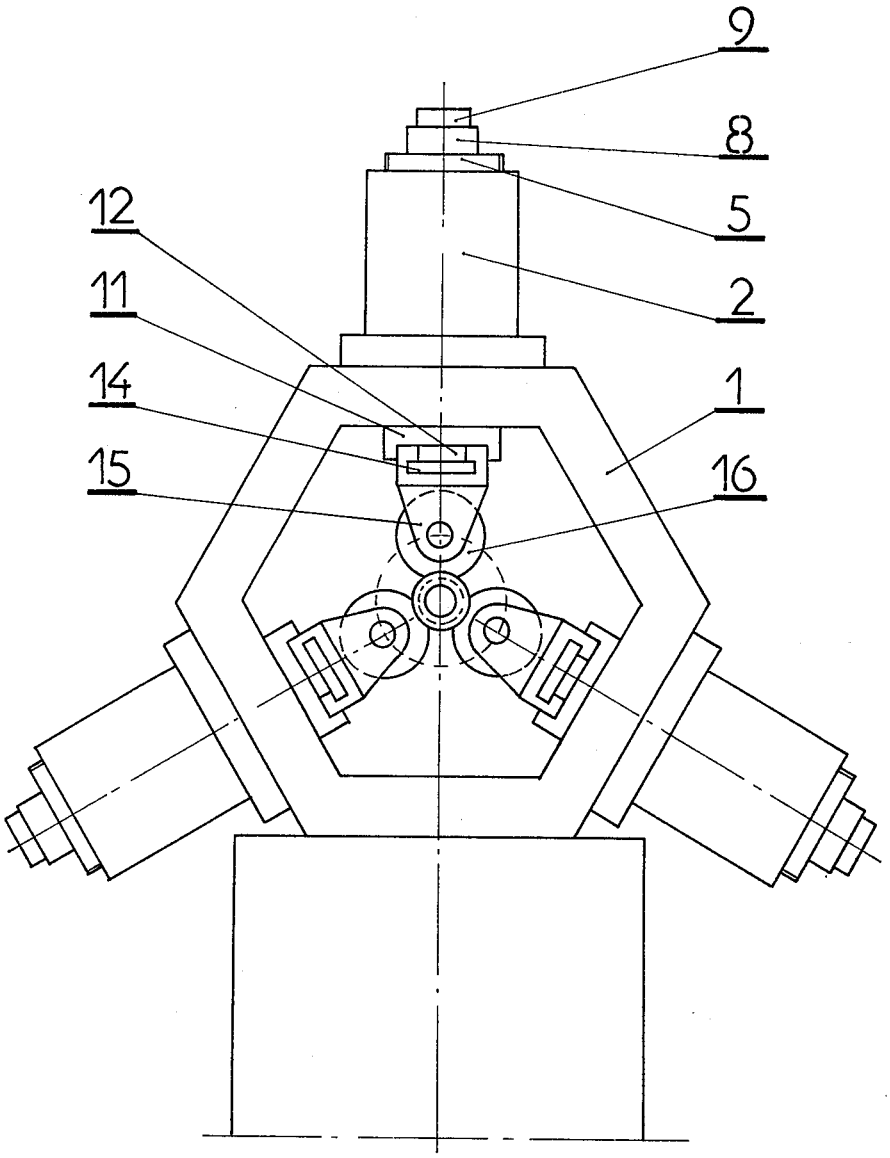
FIG. 4 is an end view of the rolling mill.

Three precisely angled frames of actuators 2 are rotatably mounted on a body 1 of a mill housing. The actuators include a piston rod 3 having two pistons.

The outer piston 4 co-operates with an external cylinder 5 which is mounted on the actuator frame 2 by means of a threaded joint. The inner piston 6 is in operative communication with an internal cylinder 7 axially slidably attached to the frame of said actuator 2. On the external cylinder 5 are rigidly fixed spacer washers 8 limiting the movement of said piston rod 3 having at its end a thrust flange 9 therefor. At the opposite end, the piston rod 3 is provided with a catch or stop flange 10. A slider 12 is mounted coaxially with said piston-rod 3 and slidably relative to a coaxial bore in the bottom part 11 of the internal cylinder 7, said slider being engageable with its catch an internal shoulder 13 on the stop flange 10 of the piston rod 3.

At the opposite end portion of said slider 12 there is provided a pressure flange 14 to press down a yoke 15 together with a tool 16 mounted thereon to said bottom 11 of the internal cylinder 7.

The slider 12 includes a chamber 17, in which the stop 10 slidably moves. In additional, the slider 12 is equipped with an outward thrust flange 18 to engage the bottom part 11 of said internal cylinder 7.

When rolling, the outer piston 4 is moved hydraulically to a bottom position, and the magnitude of the displacement is adjusted with a desired thickness of the spacer washers 8, which is in contact the thrust flange 9 of said piston rod 3. The internal cylinder 7 is then moved to its lowermost position. The axial movement of the internal cylinder 7 is limited by the flange protrusion of the slider 12, the location of which is defined by the contact of the stop 10 and the shoulder 13 and by a thickness of that portion of the yoke 15 which is placed between the pressure flange 14 of the slider 12 and the bottom part 11 of the internal cylinder 7.

The particular surfaces of the piston rod 3, slider 12 and yoke 5, which are co-operating and are hydraulically pressed with respect to each other, accurately determine the position of the tool 16 relative to the base position which is the external surface of spacer washers. The base position in relation to rolling axis, however, is fixed by displacement of the external cylinder 5 within a threaded seat of the actuator frame 2 or by changing the thickness of said spacer washers 8.

When forming a periodic rib configuration, the piston 4 is hydraulically shifted to its extreme top position to leave a portion of a pipe being unribbed. After a preset time, the piston 4 returns to its former position due to adequate variation of pressure in the hydraulic system. During the travel of the piston 4 and piston rod 3, the slider 12 with internal cylinder 7 and yoke 15 with tool 16 are also moving, the steadiness of tool attachment being maintained.

Replacement of the tool 16 is performed by pulling apart the yoke 15 previously held between the slider 12 and internal cylinder 7, moving away said tool from the rolled pipe and proper replacement of the set of the yoke and tool thereby being loosely mounted.

To disengage said yoke 15, the internal cylinder 7 should be shifted upwards, while the piston rod 3 is motionless, so that the bottom 11 is in contact with the thrust flange 18 of slider 12. Thus, between the pressure flange 14 of the slider 12 and the yoke 15 a clearance sufficient for easy handling said yoke 15 is formed.

Moving away the tool 16 from the rolled pipe is such that the internal cylinder 7 is being further shifted upwards, and thereby the slider 12 together with yoke 15.

This displacement should be in the range of 20 mm to be sufficient to stop contacting the rolling discs with a formed rib.

The magnitude of the shift is limited by a depth of the chamber 17 i.e. a bottom in which the slider 12 is abutting against the piston rod 3.

After the yoke with the tool being thus moved away from the rolled pipe, the tool assembly can be easily handled.

What we claim is:

1. A rolling mill for forming external ribs on an elongated cylindrical work piece such as a pipe, or the like, comprising a frame with three hydraulic actuator assemblies positioned at intervals of about 120 degrees from each other around the circumference of the elongated work piece and in a common plane which is transverse to the axis thereof, each actuator assembly having a rolling tool set to engage the work piece simultaneously with a corresponding tool in each of the other assemblies, each actuator assembly including a pair of coaxial pistons mounted on a common piston rod for movement toward and away from the work piece, a corresponding pair of coaxial cylinders for said pistons, the outer one of said cylinders being secured to the actuator frame, the inner one of said cylinders being slidably mounted in said frame, said inner cylinder having a bore through the inner end part thereof relative to the work piece, said bore being coaxial with said piston rod, a slider device in the form of an elongated cylinder of smaller relative dimension than the inner cylinder, said slider device being mounted for slidable movement in said bore relative to said inner cylinder, said slider device having at its inner end relative to the work piece an inwardly facing annular shoulder and an outwardly extending annular thrust flange, said piston rod having an extension coaxially extending into said slider device with an enlarged stop means on the inner end thereof engageable with said slider annular shoulder, said slider device including a thrust chamber located relatively inwardly of said shoulder and adapted to house said stop means of said piston rod, said slider device further including flange means at the inner end thereof engageable with a corresponding tool mounting yoke, said rolling tool of said actuator being mounted on said yoke adjacent the work piece, said piston rod extending through both of said cylinders and having at the remote outer end thereof a thrust flange secured against said outer cylinder fixed in said frame, and spacer means surrounding said piston rod and positioned between said outer thrust flange of said rod and said fixed outer cylinder, the numbers and dimensions of said spacer means determining the relative position of said tool relative to said work piece, and means providing fluid under pressure to said cylinders.

2. A rolling mill as defined in claim 1, wherein each of said actuator assemblies is mounted rotatably on the frame of said rolling mill, and the axis of each extends perpendicularly to the rolling axis.

* * * * *